United States Patent [19]

Fotland

[11] Patent Number: 4,935,335

[45] Date of Patent: Jun. 19, 1990

[54] MULTIPLE IMAGING

[75] Inventor: Richard A. Fotland, Holliston, Mass.

[73] Assignee: Dennison Manufacturing Company, Framingham, Mass.

2

[21] Appl. No.: 225,505

[22] Filed: Jul. 28, 1988

Related U.S. Application Data

[63] Continuation of Ser. No. 816,497, Jan. 6, 1986, abandoned.

[51] Int. Cl.[5] ..... G03C 5/16

[52] U.S. Cl. ..... 430/324; 430/321; 430/394; 430/396; 430/946; 350/167

[58] Field of Search ..... 430/14, 15, 18, 321, 430/322, 324, 325, 394, 396, 946; 350/128, 167; 354/101

[56] References Cited

U.S. PATENT DOCUMENTS

| | | | |
|---|---|---|---|
| 2,740,954 | 4/1956 | Kleefeld | 340/369 |
| 2,799,938 | 7/1957 | Anderson | 33/107 |
| 2,815,310 | 12/1957 | Anderson | 154/122 |
| 2,832,593 | 4/1958 | Anderson | 272/8 |
| 2,956,359 | 10/1960 | Smith et al. | 40/132 |
| 3,085,473 | 4/1963 | Bourgeaux et al. | 88/57.5 |
| 3,122,853 | 3/1964 | Koonz et al. | 43/42.24 |
| 3,178,993 | 4/1965 | Ferris et al. | 88/1 |
| 3,213,753 | 10/1965 | Rogers | 88/65 |
| 3,225,457 | 12/1965 | Schure | 35/9 |
| 3,284,208 | 11/1966 | Land | 430/7 |
| 3,449,158 | 6/1969 | Rowland | 156/209 |
| 3,468,545 | 9/1969 | Anderson | 279/183 |
| 3,496,262 | 2/1970 | Long et al. | 264/177 |
| 3,503,315 | 3/1970 | de Montebello | 95/18 |
| 3,526,451 | 9/1970 | Neefe | 351/160 |
| 3,553,783 | 1/1971 | de Montebello | 18/19 |
| 3,565,733 | 2/1971 | Leach | 161/2 |
| 3,582,984 | 6/1971 | Kurokawa | 178/5.4 |
| 3,586,592 | 6/1971 | Cahn | 161/2 |
| 3,617,281 | 11/1971 | Lindin | 430/396 X |
| 3,635,614 | 1/1972 | Long et al. | 425/71 |
| 3,660,919 | 5/1972 | Nagel | 40/78.03 |
| 3,706,486 | 12/1972 | de Montebello | 350/167 |
| 3,721,818 | 3/1973 | Stahlhut | 240/106 R |
| 3,734,737 | 5/1973 | Sharp . | |
| 3,742,631 | 7/1973 | Hasala | 40/106.53 |
| 3,751,258 | 8/1973 | Howe et al. | 430/496 |
| 3,781,091 | 12/1973 | Ferguson | 350/167 |
| 3,800,451 | 4/1974 | Bulkley | 40/34 |
| 3,827,783 | 8/1974 | Lemelson | 350/104 |
| 3,827,798 | 8/1974 | Alvarez | 350/189 |
| 3,832,032 | 8/1974 | Shimada | 350/128 |
| 3,884,554 | 5/1975 | Lemelson | 350/164 |
| 3,961,956 | 6/1976 | Fukuda et al. | 96/40 |
| 3,973,953 | 8/1976 | Montgomery | 96/1 R |
| 4,012,116 | 3/1977 | Yevick | 350/132 |
| 4,023,902 | 5/1977 | Ungerman | 355/52 |
| 4,130,338 | 12/1978 | Clay et al. | 350/3.82 |
| 4,164,748 | 8/1979 | Nagata | 358/3 |
| 4,214,257 | 7/1980 | Yamauchi | 358/3 |
| 4,270,985 | 6/1981 | Lipson et al. | 204/15 |
| 4,361,382 | 11/1982 | Miyoshi et al. | 350/126 |
| 4,362,806 | 12/1982 | Whitmore | 430/202 |
| 4,414,316 | 11/1983 | Conley | 430/496 |
| 4,420,221 | 12/1983 | Sparks | 350/167 |
| 4,420,502 | 12/1983 | Conley | 427/541 |
| 4,481,050 | 11/1984 | Gundlach et al. | 156/58 |
| 4,488,795 | 12/1984 | Winnek | 354/115 |
| 4,490,409 | 12/1984 | Nablo | 427/44 |
| 4,492,449 | 1/1985 | Oinoue et al. | 354/407 |
| 4,531,812 | 7/1985 | Oguino | 350/128 |
| 4,547,245 | 10/1985 | Colyer | 156/220 |

FOREIGN PATENT DOCUMENTS

| | | | |
|---|---|---|---|
| 596982 | 4/1960 | Canada | 430/946 |
| 2028938 | 6/1970 | Fed. Rep. of Germany | 430/946 |
| 1484602 | 7/1974 | United Kingdom . | |

*Primary Examiner*—José Dees

*Attorney, Agent, or Firm*—Arthur B. Moore; George E. Kersey

[57] ABSTRACT

A method and article providing different images from differing viewing angles. The image side of a lenticular sheet is printed with radiation curable inks and cured using a collimated radiation source located at a viewer position with respect to the lenticular surface. Uncured ink is removed from the printed surface, and the resulting clear region of the imaging surface may be processed further in a variety of ways. The clear region may be left unprinted, or printed with a second image different from the first, or a stereoscopic image that combines with its pre-printed mate to form a three dimensional image. The clear region also may be vacuum metallized or chemically plated to form a highly reflective surface.

11 Claims, 2 Drawing Sheets

MULTIPLE IMAGING

This is a continuation of co-pending application Ser. No. 816,497 filed on Jan. 6, 1986 abandoned.

BACKGROUND OF THE INVENTION

This invention relates to multiple imaging, and, more particular to imaging which produces different images from different viewing angles.

The production of images which change with a change in viewing angle has been known for many years. It is described, for example, by V. G. Anderson in U.S. Pat. No. 2,815,310. The images are produced on opaque or transparent sheets of material such as paper, paper board or plastic. The resulting imprint, in black and white or color, is laminated to a transparent lenticular lens. Alternatively, a transparent plastic carrier may be printed on its reverse side and viewed through a lenticular lens face of the carrier.

A lenticular screen, as is well known, has a number of lenses arranged in side-by-side relationship. Each lens, commonly termed a lenticle, may be formed by an elongated or circular convex frontal surface, and a flat rear surface.

The printed image is formed by two interleaved pictures producing a grid of parallel lines with alternating striations. The pitch, or number of picture-element pairs per unit distance, must be the same as the lens pitch of the lenticular array. In addition, the focal length of each lenticles should be equal to the thickness of the lenticular sheet Under these conditions, at one viewing angle an observer will see only one picture, while at a different angle the same observer will see the other picture.

The requirement that the picture elements be in registration with the lenticular array complicates the printing and lens forming steps. In practice, the pitch of the lenticular assembly is limited to a spacing that is equivalent to 100 lenticles per inch, or less. Even with 50–100 lenticles per inch, it is difficult to hold the registration over widths of more than a few inches. This limitation restricts the quality of pictorial resolution, as well as size.

Because of the required image registration, the cost of producing articles is substantial. In addition, the focal length of the lenticles must equal the thickness of the lenticular sheet. At a pitch of 100 lenticles per inch, assuming a half cylinder lenticular surface, the focal length for a conventional plastic sheet, having refractive index of 1.5 to 1.6 is 0.016 to 0.019 inches. The result is a relatively thick sheet that not only can have objectionable bulk but also increases the final cost of the article.

Accordingly, it is an object of the invention to facilitate multiple imaging using a lenticular sheet. A related object is to facilitate lenticular imaging at different viewing angles.

Another object of the invention is to overcome difficulties associated with the registration of picture elements in a lenticular array. A related object is to simplify printing of lenticular sheets. Another related object is to facilitate interaction between picture elements and a lenticular array.

Still another object of the invention is to improve the pictorial resolution of images associated with lenticular arrays. A related object is to achieve improved quality at a substantial reduction in cost.

A further object of the invention is to reduce the thickness of lenticular sheets associated with multiple imaging. A correlated object is to eliminate the need for thick lenticular sheets in multiple imaging.

SUMMARY OF THE INVENTION

In accomplishing the foregoing and related objects, the invention provides a method of forming an article with multiple images by providing a lenticular sheet and using the sheet to generate self-contained striated images. For that purpose the lenticular sheet is provided with an image layer desirably on a flat surface. The sheet is then subjected to collimated radiation to form bands or striations in the image layer, which is advantageously formed of a radiation curable ink.

In accordance with one aspect of the invention the image layer may be multicolored, line, half-tone, and printed by any of a variety of processes including silk-screened, gravure, flexo or planographic.

In accordance with another aspect of the invention the lens array of the sheet focuses radiation from a source and the image layer is cured in bands or striation. The uncured areas are then dissolved or rinsed away, leaving a permanent striation pattern.

In accordance with a further aspect of the invention, a second image can be printed on the image surface of the array. Where the image surface contains only one set of striated images, a particular image is seen. Where the regions without image are transparent, the interior contents of an associated package may be seen from the viewing angle associated with those regions.

In accordance with yet another aspect of the invention, a three-dimensional image is realized and alternate images are produced on the imaging surface of the lenticular lens array in stereoscopic pairs. An eye at one position sees a first image while the other eye sees another image. The combination of the two images produces a stereoscopic effect.

In accordance with a still further aspect of the invention, a multiple-imaged article is formed by a lenticular array with a radiation curable coating on one surface and striations in the coating produced by a collimated beam of radiation.

The radiation curable coating is advantageously on a flat surface of the array, and opposite the lenticles. It is desirable for the coating to be curable by ultraviolet radiation, with the uncured material rinsed to leave regions on the imaging side of the array devoid of coating.

The lenticular sheet, with its cured striated coating, can be used in packaging such that an image is seen from one viewing angle, and the interior of the package is visible from another viewing angle.

By the present invention, the requirement for image registration with the lenticular array is completely eliminated. An important advantage of the present invention is, therefore, cost reduction through the elimination of the expensive registration requirements.

Another important advantage of the invention is the attainment of higher resolution, and hence higher quality images than when registration is used.

Yet another advantage of the invention is cost reduction by using thinner plastic sheeting. The focal length of the lenticular array and the thickness of the sheet are related. By tripling the resolution, for example, the thickness of a plastic lenticular sheet can be reduced by a factor of as much as two or three.

DESCRIPTION OF THE DRAWINGS

Other aspects of the invention will be apparent after considering several illustrative embodiments, taken with the drawings in which.

DETAILED DESCRIPTION

Figure 1:
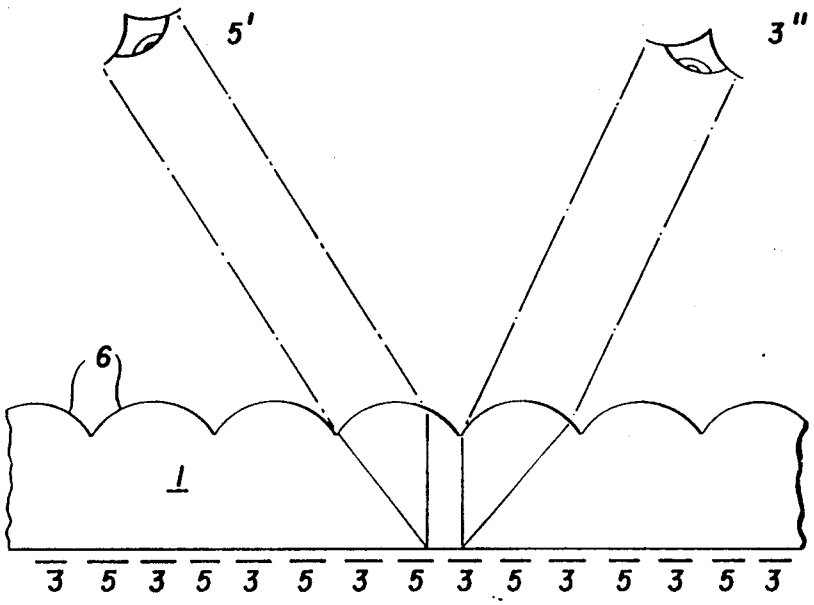
FIG. 1 is a cross-sectional view of a multiple imaging article of the prior art.

With reference to the drawings, FIG. 1 shows an element 1 for the viewing of different lenticular images at different viewing angles. The transparent lenticular sheet array 6 of FIG. 1 has, on its side opposite the senses, two respective coplaner images 3 and 5 in the form of stripes. A viewer at position 5' will see image 5 because of the focusing action of the lenticular array 6, while a viewer at position 3' will see image 3. The images 3 and 5 may be on the surface of element 1, or on the registered surface of a paper or paper board sheet, either in contact or closely spaced relative to element 1.

Formation of the multiple image article of FIG. 1 in accordance with the invention is illustrated in FIGS. 2, 3, 4 and 5.

Figure 2:
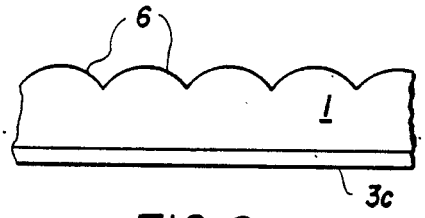
FIG. 2 is a sectional view lenticular sheet with an image coating in accordance with the invention.

FIG. 2 shows a lenticular transparent plastic sheet with a continuous image 3*c* formed of UV (ultra-violet) curable ink. The image 3*c* may be multi-colored, line or half tone and printed by any of a variety of techniques, including silkscreening, gravure, flexo, or planographic offset.

Figure 3:
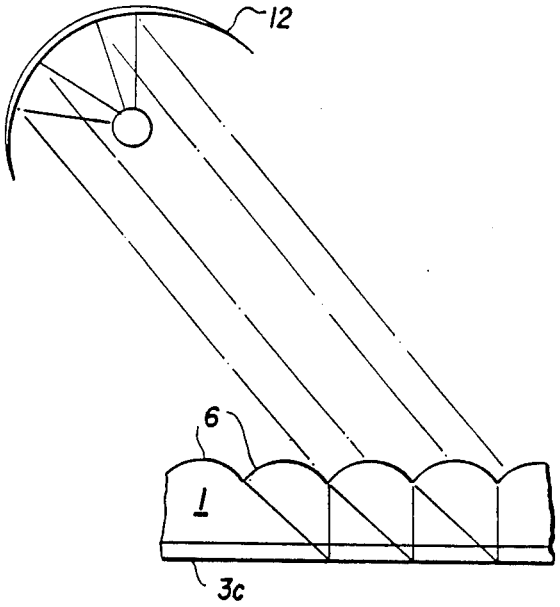
FIG. 3 is a sectional view of the sheet of FIG. 2 being irradiated.
Figure 4:
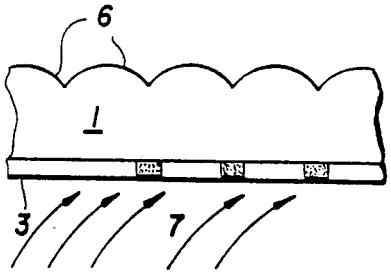
FIG. 4 is a sectional view of the sheet of FIG. 3 being rinsed after irradiation.
Figure 5:
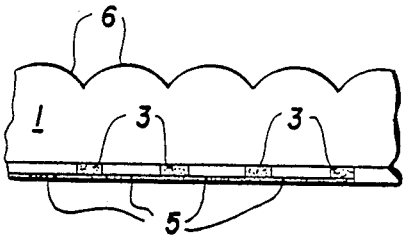
FIG. 5 is a resulting product in accordance with the invention.

The next step in the method is illustrated in FIG. 3, where the image-containing lenticular array sheet 1 is subjected to collimated radiation from an appropriate ultraviolet lamp and reflector system 12. Due to the focusing action of the lenticular array 6, the image is only cured in bands or striations. In FIG. 4 the image side 8 of the lenticular sheet 1 is subjected to a spray rinse 7, which dissolves the uncured areas of the image, leaving the image in the form of striations 3. A final, and optional step, is illustrated in FIG. 5 where a second image 5 is printed on the imaging surface 8 of the lenticular lens array 6.

In certain applications, for example packaging, it is desirable to eliminate the last step so that from one viewing angle the contents of the package may be viewed through the nonimaged region of the lenticular sheet, while from another viewing angle, the pictorial image 3 is observed.

In order to realize three-dimensional overall image the images 3 and 5 may be stereoscopic pairs. In that case, one eye positioned at 3' would see the image 3 while the other eye positioned at 5' would see image 5. For stereoscopic viewing with a typical viewing distance about 15", and an average interpupil distance of about 2.5", the angle between the viewing position 3' and 5' would be approximately 5°. Hence the geometry of images 3 and 5 would be adjusted to provide this viewing angle.

Although the figures illustrate only two different images, it is possible to produce a large number of different images, for example six, using the method of the invention. Each image is printed, exposed and then cured with UV illumination at a different angle. Furthermore, by employing a lenticular array of half sphere lenses, it is possible to generate multiple images in different directions; i.e., images which vary when the article is tipped up-and-down and side-to-side. Again, the position of the UV curing lamp defines the images seen at a particular position.

Details for carrying out this invention are illustrated in connection with the following non-limiting examples:

Example 1

A process color, half-tone image was screen printed onto the planar surface of a 0.005 inch thick vinyl film whose opposite surface was embossed to provide a lenticular surface with a density of 400 lenticles per inch. The screen print inks were of the type requiring UV curing. The wet image was cured employing a mercury vapor light source operating at a power density of 200 watts per inch and housed in a cylindrical reflector with an elliptical cross-section as shown in FIG. 3. The lamp was positioned at a angle of 30° to the normal. After curing, the portions of the image that were uncured were removed using a solvent wash spray. A high quality image was obtained when the lenticular plate was viewed from the position where the UV lamp was located during operation. At other angles the lenticular sheet was semi-transparent.

Example 2

Example 1 was repeated with an additional step of printing a second process-color image over the imaging surface of the lenticular transparent plastic sheet. This image was printed using conventional printing techniques and inks. After processing was completed, two high quality images could be viewed through the sheet at different viewing angles.

Example 3

Example 1 was repeated and the lenticular sheet placed in a vacuum chamber where the imaging surface was vacuum metallized with aluminum. After removal from the vacuum chamber, a highly reflective surface was visible at one viewing angle while the pictorial image was observed at a different viewing angle.

Example 4

Stereo separation pairs were printed on a lenticular sheet. The first stereo pair was printed with UV curing inks. The image was cured as in Example 1 and the uncured image removed. The second stereo pair was then printed also using the UV curing ink on the imaging surface of the lenticular sheet. This image was cured from the imaging side at a conventional UV curing station. A high quality three dimensional image was observed when this lenticular sheet was viewed at a distance of approximately 16".

Example 5

A first image was printed on a lenticular array using a UV curing ink which was subsequently cured through the lens array. A well-collimated ultraviolet source was used positioned at an angle of 60° to the normal. After curing, the uncured portion of the image was rinsed away by solvent. A second image was printed and subsequently cured with the UV source of an angle of 30° from normal. Again the uncured image portions were solvent rinsed. A third exposure in a position normal to the plane of the lenticular array was followed by again repeating the process at angles of −30° and −60°. The result was multiple imaging with five different images.

While various aspects of the invention have been set forth by the drawings and specifications, it is to be understood that the foregoing detailed description is for illustration only and that various changes, as well as the substitution of equivalent constituents shown and described may be made without departing from the spirit and scope of the invention as set forth in the appended claims.

I claim:

1.

An imaging method which comprises the steps of:

(a) providing a transparent lenticular sheet having on one face a pattern of lenticles and an opposite face;

(b) imprinting the opposite face of said lenticular sheet with a radiation sensitive ink formulation, wherein said ink formulation is soluble to a predetermined solvent until irradiated with a predetermined radiation, and is rendered insoluble to said predetermined solvent when irradiated with said predetermined radiation;

(c) irradiating portions of said ink formulation with a collimated beam of said predetermined radiation through the transparent lenticular sheet, thereby rendering the irradiated portions insoluble to said predetermined solvent; and (d) removing the soluble portions of said ink formulation by rinsing with said predetermined solvent.

2. The imaging method of claim 1, wherein the patterns of lenticles comprises a parallel array, and the predetermined portions comprise striations.

3. The imaging method of claim 1, wherein the irradiating step is repeated with multiple beams of collimated radiation at different angles corresponding to different viewing angles.

4. The imaging method of claim 1 wherein the opposite face is flat.

5. The imaging method of claim 1 wherein the predetermined radiation is ultraviolet (UV) radiation, and the ink formulation comprises UV curable ink.

6. The imaging method of claim 2, further comprising the final step of overprinting the ink formulation with a second ink formulation layer, wherein said ink formulation and second ink formulation layer are different colors.

7. The imaging method of claim 2, wherein the imprinting step uses one of the following processes: silk-screen, flexo or planographic.

8. The imaging method of claim 2, wherein the regions from which the soluble ink portions have been removed are left clear.

9. The imaging method of claim 2, wherein the regions from which the soluble ink portions have been removed are printed with a second image differing from that created by the irradiated ink portions.

10. The imaging method of claim 9, wherein the second image is a stereoscopic mate to the image created by the irradiated ink portions.

11. The imaging method of claim 8, wherein the clear portions are subsequently vacuum metallized or chemically plated to form a highly reflective surface.

* * * * *